United States Patent [19]

Stokoe

[11] Patent Number: 4,643,273

[45] Date of Patent: Feb. 17, 1987

[54] ACCESS EQUIPMENT

[75] Inventor: Ridley Stokoe, Tyne and Wear, United Kingdom

[73] Assignee: Aerial Access Equipment Limited, England

[21] Appl. No.: 661,291

[22] Filed: Oct. 15, 1984

[30] Foreign Application Priority Data

Oct. 18, 1983 [GB] United Kingdom ..... 8327848

[51] Int. Cl.[4] ..... B66F 11/04

[52] U.S. Cl. ..... 182/2; 182/19; 182/63

[58] Field of Search ..... 182/2, 63, 18, 19, 148; 212/149, 188; 52/118, 117

[56] References Cited

U.S. PATENT DOCUMENTS 2,905,262 9/1959 Zwight ..... 182/19
3,461,989 8/1969 Prescott ..... 182/2
4,081,055 3/1978 Johnson ..... 182/2
4,411,368 10/1983 Manjot ..... 212/149

FOREIGN PATENT DOCUMENTS 47726 3/1982 European Pat. Off. ..... 182/148
1362135 4/1964 France ..... 182/2

*Primary Examiner*—Reinaldo P. Machado
*Assistant Examiner*—Alvin Chin-Shue
*Attorney, Agent, or Firm*—Cushman, Darby & Cushman

[57] ABSTRACT

Access equipment of the type comprising a turntable on a mobile base and having a lower boom, at least one upper boom and a platform carried by the upper or uppermost boom has the operation of the lower and upper booms interlocked so that the lower boom must be locked in an elevated position before the upper boom or booms can be elevated, and at least one upper boom is extensible.

4 Claims, 3 Drawing Figures

ACCESS EQUIPMENT

BACKGROUND AND SUMMARY OF THE INVENTION

The invention is concerned with access equipment by means of which access is gained to elevated locations. More particularly, it is concerned with such access equipment in which a working platform or other load is mounted upon the upper or uppermost of two or more articulated booms and is moved to a desired elevated location by angular movement of the booms about horizontal axes.

A constant search among designers of access equipment of this type is for methods of extending the height of reach and/or the lateral extent of reach (the "outreach") of such equipment while maintaining the overall stability of the structure without, if possible, increasing the area of the equipment base. In particular, the greater the outreach beyond the limits of the base, the greater is the need to provide a counter-balancing force, in terms either of base weight or of the angle at which the lower boom is set.

The greatest outreach using a conventional two-boom design of access equipment is most conveniently achieved by allowing the lower boom to approach a vertical position and extending the upper boom horizontally. However the outreach can then only be reduced in operation by reducing the angle (the degree of verticality) of the lower boom. This causes the lower boom to extend further outwards from the base in the opposite direction and means that the operator must, in adjusting the outreach, also watch closely the movement of the lower boom (the so-called "tail-swing"). In restricted operating areas, the tail-swing may be a considerable constraint on the freedom of movement of the working platform. In public areas such as highways, the projecting of the lower boom may be a serious hazard to traffic.

In order to maintain stability of conventional access equipment during operation, it is important that the equipment be unable to get into an unstable operating position. This is usually achieved either by physically limiting the extent of movement of the booms (for example by restricting the action of the operating rams) or by providing electronic control equipment which prevents dangerous combinations of boom and platform positions from arising.

Against this background, it is an object of the present invention to provide access equipment of the above general type in which height of reach and outreach are maximised while making it possible to avoid altogether the hazard of tail-swing and simultaneously minimising the need for elaborate and costly control equipment.

The access equipment according to the present invention is characterised by two features, namely:

(a) the movements of the upper boom or booms cannot be initiated until the lower boom is locked in an elevated position; and (b) at least one upper boom is extensible.

The elevating of the booms and if desired the extending thereof may be carried out in conventional manner by the use of hydraulic rams. Thus the interlocking of the various movements to ensure that the upper boom or booms cannot be moved until the lower boom is set may be achieved mechanically and/or hydraulically, although electronic inter-locking is an acceptable alternative if desired. By way of example, the action of the ram which effects elevation of the lower boom may operate a release valve which permits hydraulic fluid to flow to the controls effecting the movements of the other boom or booms.

The lower boom may be required to be elevated to its position of maximum height before the other movements are made available to the operator or, less preferably, elevation to any lesser height and locking of the lower boom in that position may permit such other movements. Thus the lower boom elevating ram may then operate a release valve as aforesaid only when the piston of the ram reaches the maximum limit of its stroke. Alternatively, the boom itself may operate the release valve when the boom reaches its maximum elevation.

In another form of the invention, mechanical interlocking ensures that the upper boom cannot be moved until the lower boom is fixed in its position of maximum elevation.

When the lower boom has been elevated and locked in position, adjustment of the spatial position of the working platform or other load may be achieved solely by adjustment of the elevation and extension of the upper boom or booms. Thus, in the simple case of a two-boom unit, the upper boom may be elevated until it is horizontal and then the outreach is determined exclusively by the extension of the upper boom. Vertical adjustment of the position of the working platform may, in that case, be achieved by varying the angle of elevation of the upper boom.

In a further development of the access equipment according to the present invention, the lower boom may also be extensible, for example telescopic. Extension of the lower boom may be permitted either only as a second step immediately following elevation and locking of that boom or alternatively at any stage after said elevation and locking. By the first arrangement, tail-swing may need to be considered only during initial setting of the lower boom; by the second arrangement, vertical adjustment of the position of the working platform is achievable with minimum effect on the extent of outreach.

Additional extent of movement of the working platform may be achieved by providing more than one upper boom, in which case only one of the upper booms or more than one of them may be extensible.

Other features of the invention, and the advantages arising from the invention, will be more clearly seen by means of the following description, in which reference is made to the accompanying drawings, wherein:

DETAILED DESCRIPTION OF THE INVENTION

Figure 1:
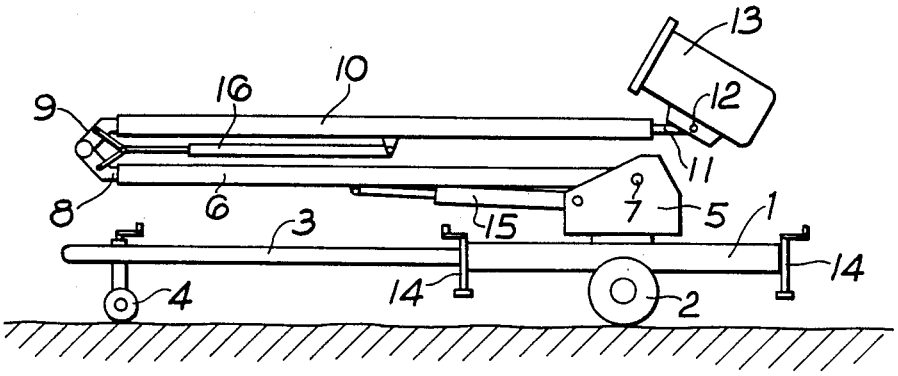
FIG. 1 illustrates in elevation one form of access lift according to the present invention, shown in "collapsed" position for towing.

Referring to the drawings, the illustrated access equipment comprises a trailer 1, mounted upon road wheels 2 and provided with a towing extension 3 supported, when not being towed, upon a retractable wheel 4. Pivotally mounted on the trailer 1 for full-circle rotation about a vertical axis is a turntable 5 carrying a lower boom 6, in turn pivoted at 7 to enable it to be swung towards the vertical. At its upper end, a telescopic extension 8 of the lower boom 6 carries a hinge unit 9 by means of which an upper boom 10 is linked at its lower end to the boom 6. The upper boom 10 is also telescopically extensible and its extension 11 carries, pivoted at 12, a personnel cage 13.

For moving to the working site, the access unit is towed on road wheels 2. Local manoeuvring of the unit at the site may be achieved using the wheels 2 and the wheel 4 in its lowered position. Throughout the moving of the unit, the beams 6 and 10 remain in the collapsed or lowered position illustrated in FIG. 1. At the site, jacks 14, which in transit are retracted at the corners of the trailer 1, are extended and lowered to provide a firm working base for the unit.

Figure 2:
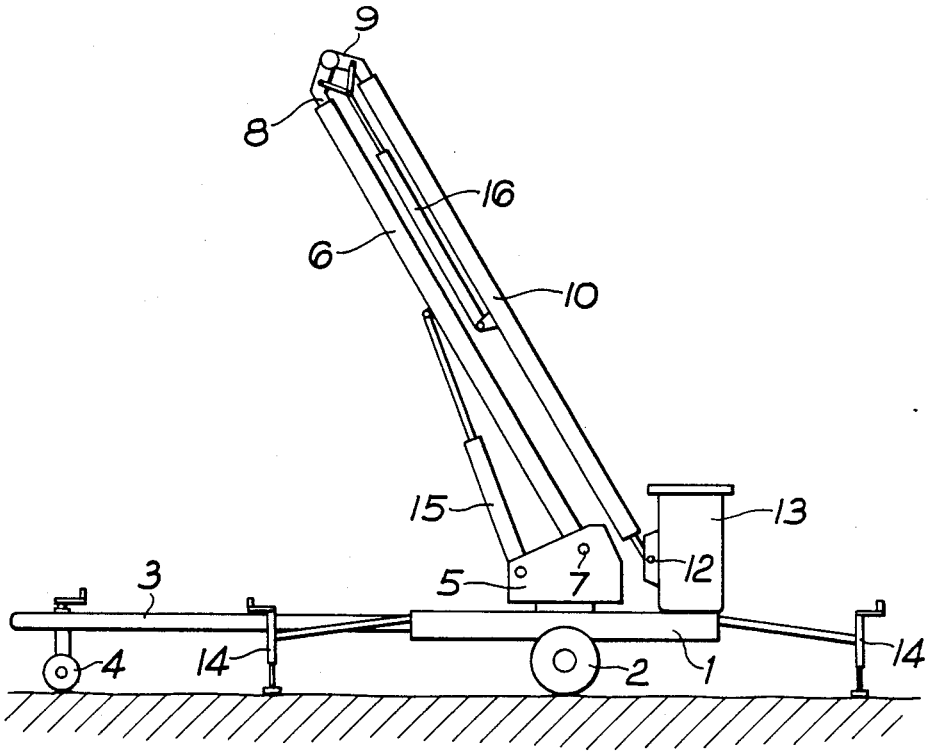
FIG. 2 shows the lift of FIG. 1 with the lower boom elevated.
Figure 3:
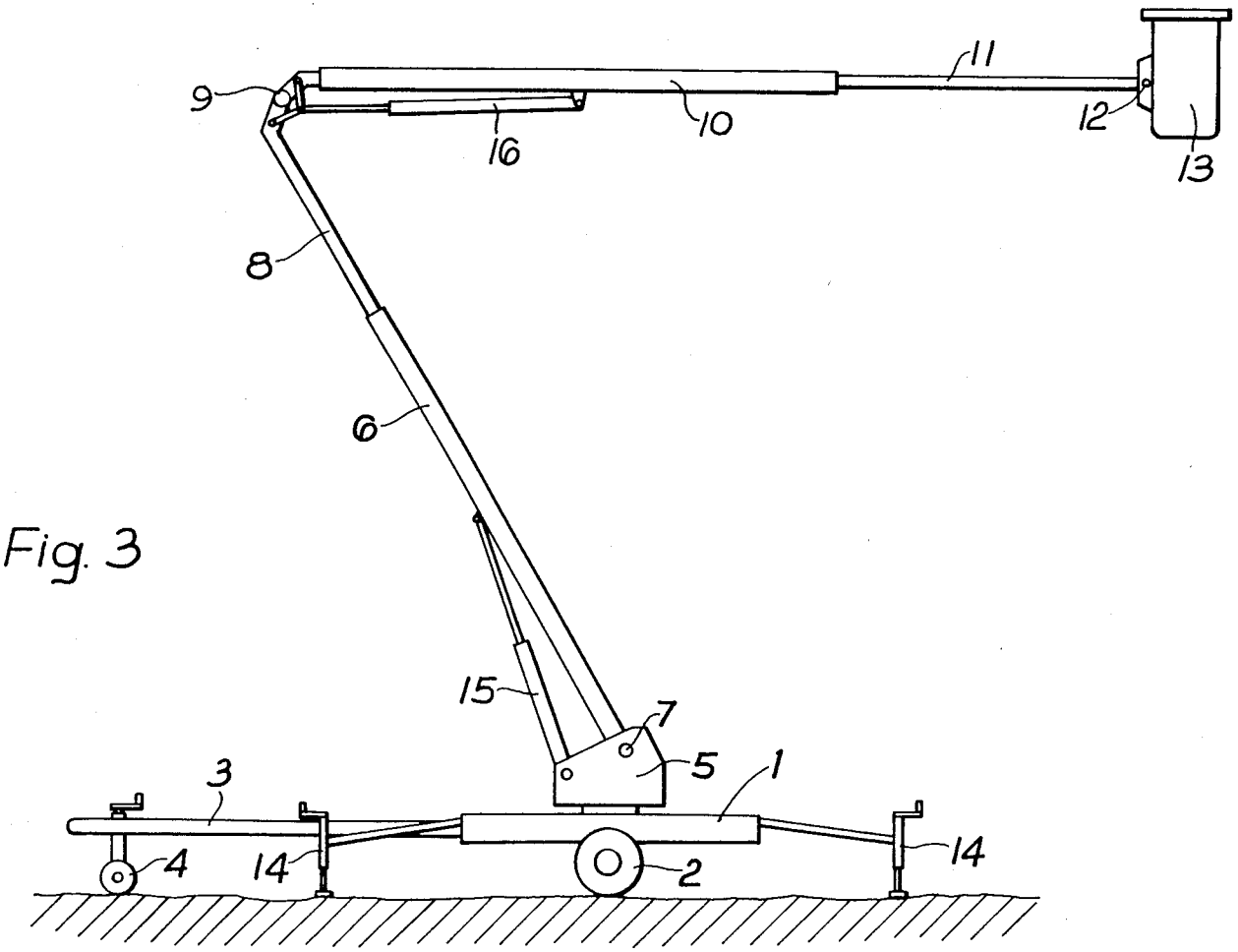
FIG. 3 shows the lift of FIGS. 1 and 2 in a working position.

It will be seen that the cage 13 is in an inclined position during transit of the unit. The first operation once the working base has been established is the raising of the lower boom 6 to an elevated position as shown in FIG. 2. In the embodiment illustrated, the boom 6 is fully elevated when it is at an angle of about 60 degrees to the horizontal; however other designs of unit may conveniently employ different angles, for example 50 degrees or 70 degrees to the horizontal. Elevating of the boom 6 is effected by means of a ram 15. When boom 6 reaches its fully elevated position, a release valve (not shown in the drawings but optionally located on the turntable 5 adjacent to the pivot 7) is automatically operated to allow hydraulic fluid to flow to the other motion controls of the access unit. Thus the movement of the upper beam 10 and all other operations are effectively prevented until boom 6 is fully elevated.

In this position of the boom 6, the personnel cage 13 is upright and may now be entered by the operator. From within the cage, he may initiate lifting of the upper boom 10, by means of a second ram 16, about the hinge 9. Interlocks within the controls ensure that for all movements after elevation of the boom 6, the cage 13 remains upright. The upper boom 10 may, by way of example, be elevated until it extends horizontally. In this position, the outreach may be altered by simple telescopic extending of extension 11 of the upper boom 10. Thus the outreach is changed without any tail-swing of the hinge 9.

Vertical adjustment of the spatial position of the cage 13 may be achieved by elevation or lowering of the boom 10 or by extending or retracting the extension 8 of the lower beam 6. The first alternative avoids the problem of tail-swing and the second has less effect on outreach.

When the operating cycle of the unit has been completed, the unit may be "collapsed" by the reverse sequence of operations, the boom 10, the cage 13 and the extensions 8 and 11 all being returned to the position shown in FIG. 2 before the lower boom 6 is lowered to the horizontal as the final operation. Because the lower boom 6 is locked in the elevated position throughout the working cycle, it is not necessary to provide, as is conventional, elaborate control equipment to prevent the lower boom being lowered when the upper boom is elevated. Moreover, for the same reason, the rams 15 and 16 and the ram (not visible in the drawings) for extending the member 8 may all be single-acting rams, since their retraction is effected by gravity.

One feature of the specific form of the invention illustrated in the drawings is that the cage-levelling controls are needed only in connection with movements of the upper beam 10. All that is required is a balancing ram on the cage 13 linked directly to an associated ram at the hinge 9.

The illustrated embodiment of the invention is specifically designed as a towable trailer unit. However, it will readily be understood that the present invention is equally suited to mounting upon a static or other form of supporting structure or for direct mounting upon a driven chassis or upon the body of a conventional or modified vehicle.

What is claimed is:

1. Access equipment comprising a mobile base, a turntable mounted upon said base for rotation relative to said base about an essentially vertical axis, an hydraulically extensible lower boom pivotted at a first end upon said turntable, a first hydraulic ram for pivotting said lower boom and thereby elevating the other end of said lower boom, at least one hydraulically extensible upper boom pivotted at a first end thereof upon said other end of said lower boom, a second hydraulic ram for pivotting said at least one upper boom and thereby elevating the other end of said upper boom, a platform pivotted on said at least one upper boom, and interlock means whereby said first and second hydraulic rams are interlocked so that said second hydraulic ram cannot be operated until said first hydraulic ram has been operated to elevate said lower boom and said lower boom has been locked in a resulting elevated position, which said platform has a rest position in which said platform is inclined to the upper boom such that said platform is inclined to the horizontal when the booms are lowered and that said platform is horizontal in said rest position when said first boom is locked in its elevated position before operation of the second hydraulic ram, hydraulic levelling means being provided to maintain said platform horizontal during operation of said second hydraulic ram, neither the lower boom nor the upper boom being extensible nor the levelling means being operable until the lower boom is locked in its elevated position.

2. Access equipment according to claim 1, wherein elevation of the lower boom operates a release valve which permits hydraulic fluid to operate said second hydraulic ram.

3. Access equipment according to claim 2, wherein said release valve is operated only when said lower boom has been elevated to a pre-determined position.

4. Access equipment according to claim 1, wherein said second hydraulic ram cannot be operated until said lower boom has been locked in a position extending upwardly at an angle of between about 50 degrees and about 70 degrees relative to the horizontal.

* * * * *